United States Patent [19]

Finkl et al.

[11] 4,026,727

[45] May 31, 1977

[54] FATIGUE RESISTANT STEEL, MACHINERY PARTS AND METHOD OF MANUFACTURE THEREOF

[75] Inventors: Charles W. Finkl; Albert L. Lehman, both of Chicago, Ill.

[73] Assignee: A. Finkl & Sons Company, Chicago, Ill.

[22] Filed: Nov. 4, 1975

[21] Appl. No.: 628,748

[52] U.S. Cl. ..... 148/2; 75/124; 75/128 V; 75/128 W; 148/12.4; 148/36; 148/39

[51] Int. Cl.[2] ..... C22C 38/06; C22C 38/44; C22C 38/46

[58] Field of Search ..... 75/123 J, 124, 128 V, 75/128 W; 148/36, 2, 12.4, 39

[56] References Cited

UNITED STATES PATENTS

| | | | |
|---|---|---|---|
| 2,798,805 | 7/1957 | Hodge et al. | 75/128 V X |
| 3,110,635 | 11/1963 | Gulya | 75/124 |
| 3,258,372 | 6/1966 | Miller et al. | 148/36 |
| 3,489,620 | 1/1970 | Current | 148/36 X |
| 3,726,724 | 4/1973 | Davies et al. | 75/124 X |
| 3,912,553 | 10/1975 | Waid et al. | 75/124 X |

*Primary Examiner*—Arthur J. Steiner

[57] ABSTRACT

A steel especially adapted for applications in which high fatigue resistance is required, and having a nominal composition of:

C — from about 0.16 to about 0.28
Mn — from about 0.50 to about 1.00
Si — from about 0.15 to about 0.35
Ni — from about 0.40 to about 1.10
Cr — from about 0.40 to about 1.15
Mo — from about 0.15 to about 0.30
S — 0.025 max.
P — 0.025 max.

together with:

a. V from a minimum of about 0.04 in the absence of Al to a maximum of about 0.08, or
b. Al from a minimum of about 0.030 in the absence of V to a maximum of about 0.19, or
c. V and Al in combination in an amount sufficient to produce a grain size of 5 or finer ASTM Fe — balance
$H_2$ — 2.5 ppm maximum
$O_2$ — 50 ppm maximum, a method of making a special machinery part, such as a hammer rod, from the above composition, and a forged part made from the above composition is disclosed.

7 Claims, No Drawings

FATIGUE RESISTANT STEEL, MACHINERY PARTS AND METHOD OF MANUFACTURE THEREOF

This invention relates to a steel especially adapted for application in which high fatigue life is required, such as hammer rods, and at the same time is applicable to a wide range of special machinery uses.

For many years the forging industry has sought to develop a steel which would consistently yield several thousand hours of life as a hammer rod in a forging press. A number of conventional steels have been employed from time to time, including 4340, MPR 45, 3310, 9310, 9320, HY80 and 8620. Possibly the most popular steel is use today for hammer rods is 4340 rolled heat-treated bar stock which, if the users requirements are great enough, can be purchased directly from a steel mill. However none of the currently used steels have been outstanding in applications in which high fatigue strength was a critical or limiting requirement. And nearly invaribly, any such steel had only limited utility since it could not, without substantial modification, be adapted to other, quite dissimilar applications such as carburized pistons, carburized gear train components, rolls for continuous casting machines, arbors, cams and other machinery parts.

SUMMARY OF THE INVENTION

Accordingly, the primary object of this invention is to provide a special machinery steel which will yield long production runs in high fatigue applications, such as hammer rods.

Another object is to provide a steel as above described which can, in addition, be adapted with little or no modification to numerous other specialized machinery applications including carburized gears, carburized pistons, carburized pinions, carburized shafts, rolls for continuous casting machines, arbors, boring bars, bushings, cams, spindles, other carburized machinery parts, drop hammer parts, rams, tie plates and T bolts.

A further object is to provide a method of making a special steel as above described.

Other objects and advantages of the invention will be apparent from a reading of the following description which is exemplary, and not definitive, in scope.

DESCRIPTION OF SPECIFIC EMBODIMENT

The composition of the new steel in its broadest form, in weight percent, is as follows:

C — from about 0.16 to about 0.28
Mn — from about 0.50 to about 1.00
Si — from about 0.15 to about 0.35
Ni — from about 0.40 to about 1.10
Cr — from about 0.40 to about 1.15
Mo — from about 0.15 to about 0.30
S — 0.025 maximum
P — 0.025 maximum together with:

a. V from a minimum of about 0.04 in the absence of Al to a maximum of about 0.08, or
b. Al from a minimum of about 0.030 in the absence of V to a maximum of about 0.10, or
c. V and Al in combination in an amount sufficient to produce a grain size of 5 or finer ASTM, Fe — Balance
$H_2$ — 2.5 ppm maximum
$O_2$ — 50 ppm maximum.

Use of the steel as a hammer rod, which is possibly the most severe operating condition to which the steel will be applied in commercial application, will be assumed in the following description of properties and method of fabrication.

Carbon in an amount of at least about .16 is required in order to ensure sufficient strength in the final product. If more than about 0.28 C is present, the steel may not be sufficiently tough to provide the excellent fatigue life which is one of the principle desirable features of the steel.

It should be noted that the aforementioned relatively low carbon content is one of the most unique features of the new steel, since prior steels used in the high fatigue environments for which the present steel is intended have nearly always, in conformity with accepted thinking in the art, contained substantially larger amounts of C. Accordingly, maintenance of control of the carbon content is considered one of the most essential and characterizing features of the new steel.

If less than about 0.50 Mn is present it may be difficult to obtain the required hardenability. Also, insufficient Mn might be present to tie up the S as MnS thereby producing weak skinned ingots. It should be noted that hardenability, that is, the ability to harden to a uniform or substantially uniform degree at all locations in a thick section, as contrasted to hardness, may be a prime requirement in many uses to which the steel may be applied. If more than about 1.00 Mn is present, the steel may, unless costly and commercially impractical precautions in the melting cycle are employed, be dirty; the presence of manganese derived inclusions from the melting process may have a significant deleterious effect on the fatigue life of the steel. Accordingly, rather careful control of Mn is another important feature of the present steel.

If less than about 0.40 Ni is present the desired hardenability will not be attained. If more than about 1.10 Ni is present the surface of the steel may be in tensile stress, and this condition tends to reduce fatigue resistance as explained more fully hereinafter.

If less than about 0.40 Cr is present the desired hardenability will not be obtained. If more than about 1.15 Cr is present, the surface of the steel may be in tensile stress and this condition tends to reduce fatigue resistance.

If less than about 0.15 Mo is present the desired hardenability will not be attained. If more than about .30 Mo is present, the surface of the steel may be in tensile stress, and this condition tends to reduce fatigue resistance.

With respect to the presence or absence of tensile or compressive stress in the surface of the steel, the following should be noted.

Normally, a condition of substantial compressive stress in the surface of the steel is preferred. If, for example, a compressive stress of about 10,000 psi exists in the surface layer of a hammer rod, and a hammer rod in normal usage is subject to momentary loads of about 50,000 psi tensile, or more, the net stress in the steel surface will be only about 40,000 psi tensile. If the hammer rod or other part is subjected to an abnormally large stress, as for example which may occur when a forge blank is located off center, the part, such as a hammer rod, may be subjected to momentary tensile stress overloads of great magnitude which, if at all possible, should be counteracted to the extent possible by the presence of a residual compressive stress in the steel.

For hammer rods and, indeed, nearly all of the other specified uses, a fine grain steel is essential to satisfactory performance. The term "fine grain" is used in its ordinary sense as understood in the trade today, namely, a grain size of 5 or finer as defined by the well known ASTM Standards.

In order to achieve the fine grain required by the demanding uses to which the steel of the present invention is subjected, V or Al, or a combination of V and Al should advantageously be employed.

If V is used to the exclusion of Al, a minimum of about 0.04 V should be present. The maximum V in this event should be no greater than about 0.08, or at most about 0.10, since V, if present in quantities above the aforementioned levels, will, in this steel, have no significant effect on grain size.

If Al is used to the exclusion of V, a minimum of about 0.030 Al should be present. The maximum Al in this event should be no greater than about 0.10, since any quantity of Al from about 0.030 up to and including 0.10 will inevitably yield the desired grain size effect. If Al substantially in excess of 0.10 is present, eventually a tendency to grain coarsening can set in. Also, a tendency toward greater non-metallic inclusions exists which affects surface notch toughness.

It should also be understood that a combination of V and Al may be used to achieve the desired grain size effect. In this event, no specific relationships can be formulated since exact proportionality limits are exceedingly difficult to define. The skilled steel maker will know for example that if his melt tests out at about 0.02 V, at least about 0.025 Al should be present to achieve the desired grain size.

A minimum amount of S is believed to be advantageous in the control of non-metallics, although the exact physical and chemical effects attributable to substantial quantities of S cannot be predicted with absolute accuracy. It is believed however that S may have the tendency to envelop the non-metallics. The consequent reduction of the deleterious effects on fatigue results from a lack of sharp edges attributable to $Al_2O_3$ inclusions and other similar non-metallics. The exact effect is believed, to some degree at least, to be attributable to conversion of the sharp edges to a more spheriodized form of inclusion.

Hydrogen should be present in an amount no greater than about 2.5 ppm in order to avoid failure in service due to hydrogen embrittlement.

Oxygen is maintained at 50 ppm or less to ensure a low final inclusion content. Final oxygen contents in this range require specialized and carefully controlled melting conditions so that failure in service will not result because of cracks which propagate from inclusions attributable to a high oxygen content.

A typical fabrication cycle from which a hammer rod is formed will be as follows.

A heat of steel is melted in in an electric furnace, preferably under a single slag process. Thereafter the heat may be tapped into a treatment vessel, such as a conventional ladle, and transported to a vacuum treatment station. At the vacuum treatment station the heat is subjected to the combined effects of vacuum, gas purging and electric arc heating, all as more fully described in U.S. Pat. Nos. 3,236,635; 3,501,289; 3,501,290; and 3,635,696, the descriptions of which are incorporated herein by reference.

Following treatment at the aforementioned vacuum treatment station, which may include refining for sulphur control if desired or required, the melt is then argon teemed to prevent further oxide formation into a suitable receptacle, such as an ingot mold.

After stripping and cooling and conventional heat treatment, the ingot is double converted. In the double conversion process an ingot of, for example, about 34 inches square may be forged to a cog size of about 14 inches square. Thereafter the cogged ingot may be conditioned, as by torching off bad surface areas. Following conditioning, the ingot may be forged to final size, such as rod diameters of as small as 4½ inches. If equipment is available, the ingots should be bottom poured to minimize surface imperfections, and thereby decrease conditioning requirements. If bottom pouring, or up-hill teeming is employed, argon teeming and double conversion may be eliminated.

In the event a case hardened product is desired, the rod or other part, after forging to size and heating, may be hardened vertically in a quench system substantially as described in co-pending applicaton Ser. No. 200,393 which application is assigned to the assignee of the instant application. A depth of case of about one-half inches and a hardness of close to 50 Rc may be obtained.

A typical and preferred composition of a hammer rod which has been produced by the above described process is as follows:

C — 0.19;
Mn — 0.70;
Si — 0.25;
P — 0.025 max.;
S — 0.025 max.;
Ni — 1.00;
Cr — 1.00;
Mo — 0.25 together with:

V — .04 in the absence of Al, or
Al — .030 in the absence of V, or
A combination of V plus Al sufficient to yield a grain size of 5 ASTM;
1.7 $H_2$ ppm;
$O_2$ 35 ppm.

Although a preferred embodiment of the invention has been described, it will be understood that the foregoing description is intended to be exemplary and not definitive. Accordingly it is intended that the scope of the invention be defined, not by the scope of the foregoing description, but rather by the foregoing description as interpreted in light of the pertinent prior art.

We claim:

1. A machinery part made from a steel having, after conventional post-melting treatment, high fatigue resistance and a low inclusion frequency, said steel having a grain size of ASTM 5 or finer and consisting of:

C — from about 0.16 to about 0.28,
Mn — from about 0.50 to about 1.00,
Si — from about 0.15 to about 0.35,
NI — from about 0.40 to about 1.10,
Cr — from about 0.40 to about 1.15,
Mo — from about 0.15 to about 0.30,
S — 0.025 max.,
P — 0.025 max., together with:

a. V from a minimum of about 0.04 in the absence of Al to a maximum of about 0.08, or b. Al from a minimum of about 0.030 in the absence of V to a maximum of about 0.10, or c. V and Al in combination in an amount sufficient to produce a grain size of ASTM 5 or finer, said V and/or Al being present in an amount sufficient, with respect to (a) and (b) as well as (c) above, to produce a grain size of ASTM 5 or finer, and Fe — Balance
$H_2$ — 2.5 ppm maximum
$O_2$ — 50 ppm maximum

2. The machinery part of claim 1 further characterized in that the alloy components are present in the following approximate amounts:

C — 0.19; Mn — 0.70; Si — 0.25; Ni — 1.00; Cr — 1.00; Mo — 0.25; S — 0.015; P — 0.013; V — 0.02; Al — 0.025; $H_2$ — 1.7 ppm and $O_2$ — 50 ppm.

3. The machinery part of claim 1 further characterized in that the machinery part is a hammer rod.

4. In a method of making a machinery part made from a steel having, after conventional post-melting treatment, high fatigue resistance and a low inclusion frequency, said steel having a grain size of ASTM 5 or finer and consisting of:

C — from about 0.16 to about 0.28,
Mn — from about 0.50 to about 1.00,
Si — from about 0.15 to about 0.35,
Ni — from about 0.40 to about 1.10,
Cr — from about 0.40 to about 1.15,
Mo — from about 0.15 to about 0.30,
S — 0.025 max.,
P — 0.025 max., together with:

a. V from a minimum of about 0.04 in the absence of Al to a maximum of about 0.08, or b. Al from a minimum of about 0.040 in the absence of V to a maximum of about 0.10, or c. V and Al in combination in an amount sufficient to produce a grain size of ASTM 5 or finer, said V and/or Al being present in an amount sufficient, with respect to (a) and (b) as well as (c) above, to produce a grain size of ASTM 5 or finer, and Fe — balance
$H_2$ — 2.5 ppm maximum
$O_2$ — 50 ppm maximum the steps of melting a heat substantially to specification, subjecting said heat while in molten condition to the combined effect of a vacuum, gas purging and electric arc heating, teems said heat under a protective gas shroud into an ingot mold, double converting the ingot by initially forging said ingot to a size intermediate the initial and the final desired size, conditioning the intermediate sized forged ingot, and final forging the ingot to size.

5. The method of claim 4 further characterized in that the forged part is case hardened to approximately 50 Rc by subjection to a vertical quench.

6. The method of claim 4 further characterized in that the ingot is bottom poured in lieu of protective gas teeming and double conversion.

7. The method of claim 6 further characterized in that the forged part is case hardened to approximately 50 Rc by subjection to a vertical quench.

* * * * *